United States Patent [19]

Skripalle

[11] Patent Number: 4,608,807

[45] Date of Patent: Sep. 2, 1986

[54] PROCESS FOR WRAPPING A ROTATING BALE OF A BACKED MINERAL FIBER STRIP WITH A PROTECTIVE STRIP THAT IS APPLIED DURING WINDING OF THE BALE, FOR PACKAGING

[75] Inventor: Werner Skripalle, Bergisch Gladbach, Fed. Rep. of Germany

[73] Assignee: Isover Saint-Gobain, Courbevoie, France

[21] Appl. No.: 602,491

[22] Filed: Apr. 20, 1984

[30] Foreign Application Priority Data

Apr. 20, 1983 [DE] Fed. Rep. of Germany ..... 3314289

[51] Int. Cl.[4] ..... B65B 11/04; B65B 63/04

[52] U.S. Cl. ..... 53/399; 53/118; 53/214; 53/430; 53/587

[58] Field of Search ..... 53/116, 118, 211, 214, 53/397, 399, 430, 465, 587

[56] References Cited

U.S. PATENT DOCUMENTS

| | | | |
|---|---|---|---|
| 765,606 | 7/1964 | Waldron | 53/118 |
| 3,052,073 | 9/1962 | Johansen et al. | 53/118 |
| 3,273,301 | 9/1966 | Anderson | 53/214 X |
| 3,494,095 | 2/1970 | Valvano | 53/465 |
| 3,813,843 | 6/1974 | Wooldridge et al. | 53/118 X |
| 3,927,504 | 12/1975 | Forrister | 53/430 |
| 3,964,235 | 6/1976 | Miller et al. | 53/118 |

FOREIGN PATENT DOCUMENTS

| | | | |
|---|---|---|---|
| 1372595 | 8/1964 | France | 53/118 |

*Primary Examiner*—Fred Silverberg
*Assistant Examiner*—Michael D. Folkerts
*Attorney, Agent, or Firm*—Oblon, Fisher, Spivak, McClelland & Maier

[57] ABSTRACT

A process for wrapping a rotating bale of mineral fiber strip in the form of a felt-roll with an outer closed-face backing strip with protective wrapping applied as part of the winding process for packaging which entails bringing the protective wrapping, having a coating of adhesive material at the back end thereof into the circumferential area of the rotating bale with the front end thereof, with a length exceeding the circumference of the bale and being frictionally connected to the bale; and turning the bale and pressing the back end of the protective wrapping onto the outside of the winding of the protective wrapping, therebelow, to attain a lasting bonding, wherein the frictional sticking connection between the front end of the protective wrapping and the bale is produced exclusively by an adhesive effect, between the inner surface facing the bale and the bare outer surface of the backing strip, and the front end of the protective wrapping is placed on the bale at a distance from the outside end of the last winding of the felt roll, and wherein the length of the protective wrapping exceeds the circumference of the enclosed bale substantially only by the circumferential width of the bonding zone between the back end of the protective wrapping and the outside of the winding of the protective wrapping lying thereunder.

9 Claims, 1 Drawing Figure

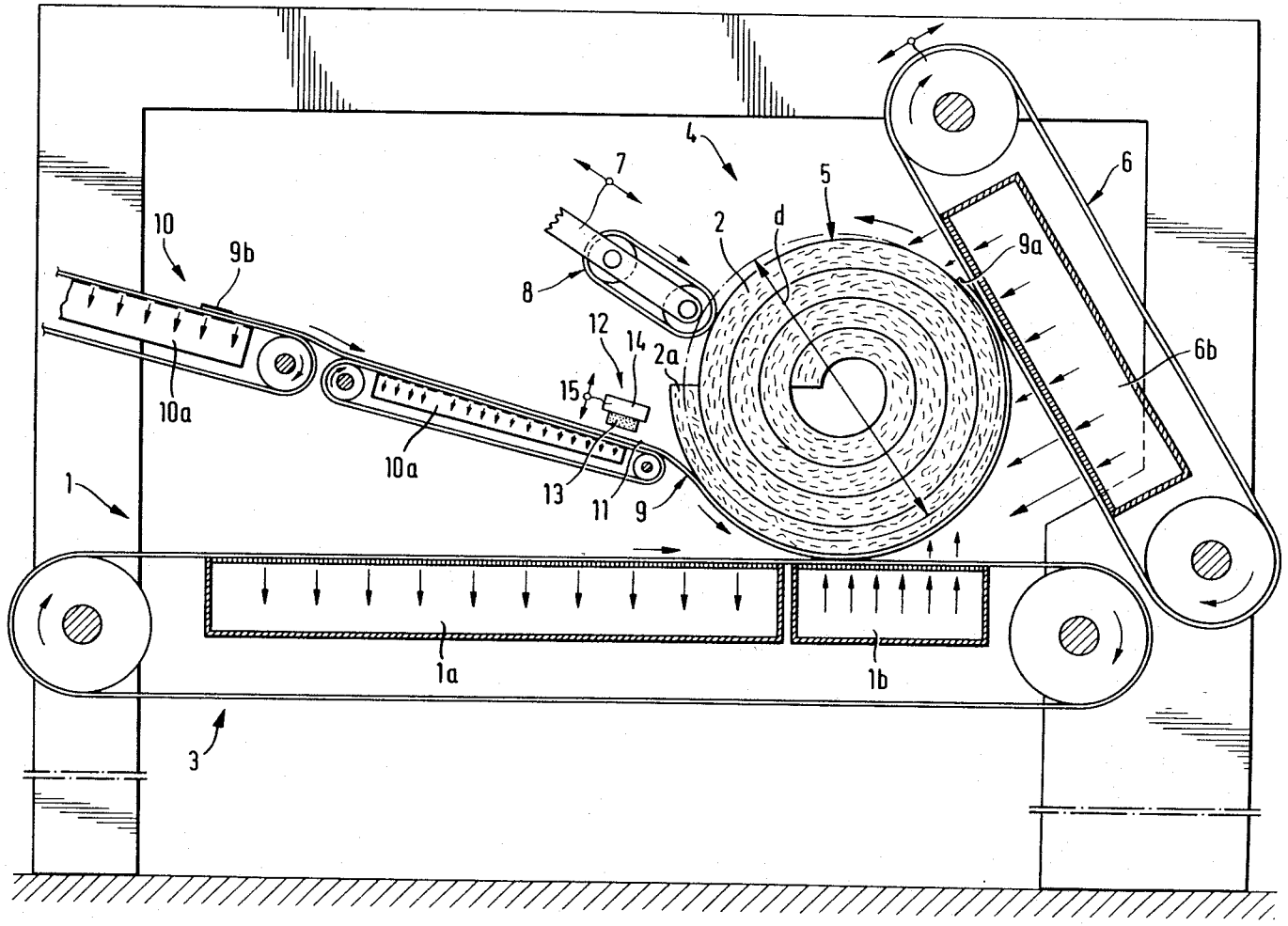
6b
6
9a
5
d
2
4
2a
14
12
15
7
8
9
11
13
1b
1a
10a
9b
10
10a
1
3

PROCESS FOR WRAPPING A ROTATING BALE OF A BACKED MINERAL FIBER STRIP WITH A PROTECTIVE STRIP THAT IS APPLIED DURING WINDING OF THE BALE, FOR PACKAGING

BACKGROUND OF THE INVENTION

1. Field of the Invention:

This invention relates to a process for wrapping a rotating bale of a backed mineral fiber strip, in the form of a felt roll, with an external closed-face backing, with a protective strip which is applied during winding of the bale; and a device for effecting the process.

2. Description of the Prior Art:

To produce a backed felt roll, mineral fibers with bonding agent are placed on a production line, concentrated to the desired degree and hardened in a tunnel furnace; thereafter, a backing strip, especially one made of aluminum, is applied and bonded to the felt strip so produced. The bonded felt strip so obtained is cut to the required length and the cut sections are wound into bales and enclosed in protective wrapping made of paper or plastic film and thus held together for storage and transportation. Such a backed felt roll is produced and marketed by the applicant under the designation "Rollisol" (registered trade mark) and is used especially for inside roof insulation between the rafters.

To enclose the wound bale in the protective wrapping, segments of the protective wrapping cut to the required length are kept in readiness on a feed conveyor of their own and, in accordance with the advance movement of the felt roll to the winding station, are so fed in that the front end of the protective wrapping is clamped in and carried in the angle between the outside of the already wound felt and the inside of the tailing end of the felt when entering the winding station. Then the completed bale makes another turn and, in doing so, winds the protective wrapping around the outside of the bale starting from the front end until the back end of the protective wrapping overlaps a previously wound middle area of the protective wrapping. Prior to that, the back end has been provided with a quick setting, durably effective adhesive agent and is pressed on during the winding movement, so that the wrapping of the bale with the protective wrapping is continuous and fixed in this position. Then the bale is ejected from the winding station and—in case of a bilaterally protruding shrink film as protective wrapping after pasing through a heating zone for shrinking of the edges as edge protection—stacked and transported.

Carrying the front end of the protective wrapping with the rotating bale by having the front end enter into the last winding of the felt and clamping it in is customary; only by way of example, reference is made to DE-AS No. 12 39 979 and DE-AS No. 14 61 821 or U.S. Pat. No. 3,052,073. This procedure to achieve continuous wrapping over the entire circumference by a protective wrapping automatically as part of the winding process has replaced the former procedure evident, for example, from U.S. Pat. No. 2,681,702, according to which only the felt strip was wound and the last winding of the bale was then held in place and secured by means of a narrow adhesive tape strip; it is obvious that such safeguarding during transport merely by a narrow adhesive tape strip is inadequate for reasons of proneness to damage.

However, a well-known and long-felt problem of continuous wrapping over the entire circumference consists in the fact that the consumption of packaging material in the form of protective wrapping per bale is very high. This has essentially three reasons:

1. To guarantee reliable carrying of the protective wrapping between the end of the felt and the previously wound layer of felt, the overlap of the front end of the protective wrapping with the end of the felt must be relatively wide, as a rule a few decimeters, particularly since the clamping pressure, because of the pliability of the felt, is not that great and takes full effect only sometime after the feed of the front end of the protective wrapping during the further winding movement. Thus the producer of a winding station used in practice cites an estimated overlapping length of 0.5 m between the back end of the felt strip and the front end of the protective wrapping.

2. After one rotation of the bale with the protective wrapping, the latter gets into the area of the end of the felt strip. The felt strip is at least several centimeters thick, as a rule 10 cm or more, so that the trailing end of the felt strip supports the area of the protective wrapping above from the beginning area of the protective wrapping below. Therefore, the protective wrapping must be pulled quite a bit over the trailing end of the felt under tension and under compression of the end of the felt to attain a bonding zone with the preceding winding of the protective wrapping which, on account of the spatial distance, is sufficiently relieved of the spreading forces of the back end of the felt to guarantee a safe bond here as part of the winding process. The distance behind the end of the felt strip needed to join the upper protective wrapping with its previous winding may also amount to a few decimeters.

3. Under severe production conditions, short, slight disturbances of the feed control of the protective wrapping as well as slight changes of adjustments, for example of the advancing mechanism for the protective wrapping, cannot be ruled out. Therefore, it happens time and again that a protective wrapping runs in the winding slightly deviating from the desired feed control. Especially at high production speeds, such slight deviations lead to a possibly considerable variation in the degree of overlapping between the area of the front end of the protective wrapping and the area of the trailing end of the felt. Thus if faulty packaging resulting from fluctuations of the feed time of the protective wrapping occurring during operations to be avoided then, on the one hand, work must be done with such great nominal length of overlap that also in case of a delay of the feed, adequate overlap and carrying are guaranteed and, on the other hand, with such lengths of protective wrapping that, in case of somewhat premature feed, the trailing end of the felt is covered sufficiently widely on the winding by the film strip and tidy bonding at a distance from the trailing end of the felt is guaranteed.

To wrap a bale with an average diameter of 55 cm, and thus a nominal circumference of 173 cm, as a result requires in practice the use of a protective wrapping measuring well over 3 m, in other words, nearly twice the nominal circumference. It is obvious that in mass production even with an inexpensive material for the protective wrapping, such as paper, this comes to a considerable amount; in the case of more expensive material, such as plastic shrink film, this causes a clearly noticeable rise in cost, especially since the protective wrapping in practice must also be used with continuous printing.

It can be seen that a corresponding problem also arises if in place of a backed felt roll another material is to be wound on rolls and wrapped. The material consumption for the protective wrapping because the greater the thicker the trailing end of the winding material and the lower the clamping pressure which the winding material can exert on the front end of the protective wrapping. However, completely apart from the material, is the requirement of a control of the feed time of the protective wrapping, which must be precise as possible, to achieve in each case the desired overlapping with the trailing end of the winding material.

Hence, a need clearly continues to exist for a process for wrapping a rotating bale by which the consumption of material for the protective wrapping can be considerably reduced without abandoning continuous wrapping over the entire circumference.

SUMMARY OF THE INVENTION

Accordingly, it is an object of the present invention to provide a process for wrapping a rotating bale by which the consumption of material for the protective wrapping can be considerably reduced.

It is also an object of this invention to provide a process for wrapping a rotating bale by which the consumption of material for the protective wrapping can be considerably reduced without abandoning continuous wrapping over the entire circumference and without producing engineering disadvantages.

According to the present invention, the foregoing and other objects are attained by providing a process for wrapping a rotating bale of backed mineral fiber strip in the form of a felt roll with an outer-closed face backing strip with protective wrapping to be applied as part of the wrapping process, for packaging, which involves bringing the protective wrapping, having a coating of adhesive material at the back end thereof, into the circumferential area of said rotating bale with the front end thereof, with a length exceeding the circumference of the bale and without using an adhesive resulting in a lasting bond, is frictionally connected to the bale; and appropriately turning the bale and pressing the back end of the protective wrapping onto the outside of the winding of the protective wrapping, therebelow, to attain a lasting bonding, wherein the frictional coupling connection between the front end of the protective wrapping and the bale is produced exclusively by an adhesion effect, between the inner surface facing the bale and the bare outer surface of the backing strip, and the front end of the protective wrapping is placed on the bale at a distance from the outside end of the last winding of the felt roll, and wherein the length of the protective wrapping exceeds the circumference of the enclosed bale substantially only by the circumferential width of the bonding zone between the back end of the protective wrapping and the outside of the winding of the protective wrapping lying thereunder.

BRIEF DESCRIPTION OF THE DRAWINGS

Other objects, features and attendant advantages of the present invention will be more fully appreciated as the same becomes better understood from the following detailed description when considered in connection with the accompanying drawing in which like reference characters designate like or corresponding parts and wherein FIG. 1 illustrates a schematically simplified side view of a device according to the present invention.

DETAILED DESCRIPTION OF THE PREFERRED EMBODIMENTS

According to the present invention, the front end of the protective wrapping is not permitted to run into the winding by the trailing end of the winding material to carry the protective wrapping by friction without adhesive, but the protective wrapping is attached to the bare outer surface of the felt roll, which is formed by a closed-face backing strip. Thus, only a sticking or adhesion connection is attained that can easily be undone during unpacking of the packed felt roll by the user without damaging the backing strip; however, in doing so, the protective wrapping need not be overlapped with the last winding of the felt roll with the accompanying disadvantages. This attaching of the front end of the protective wrapping takes place by control of the feed time of the protective wrapping, suitably in the area that is approximately opposite the trailing end of the mineral fiber strip, thus is influenced by it as little as possible. In this case, deviations even of several decimeters for roll diameters of half meter or more in practice are harmless because it is only important that neither the attachment of the front end of the protective wrapping nor the subsequent bonding of the back end of the protective wrapping be influenced by the trailing end of the mineral fiber strip; therefore, high demands for the control precision for feed of the protective wrapping are obviated, and in practice considerable deviations from the desired feed time are permissible without causing any trouble and especially without requiring any compensation by requiring a greater available length of the protective wrapping. The distance of the back end of the protective wrapping, in measuring the protective wrapping with a length which is only slightly, namely by the circumferential width of the bonding zone, longer than the nominal circumference of the bale, from the trailing end of the mineral fiber strip is just as great as the front end. Therefore, the bonding of the back end of the protective wrapping takes place at a corresponding distance from the trailing end of the mineral fiber strip without trouble and without need for additional material for the protective wrapping. The trailing end of the mineral fiber strip is in a middle area of the protective wrapping and is clearly spanned by it without influencing the attaching point at the front end of the protective wrapping and the bonding point at the back end of the protective wrapping in a middle area. Thus the protective wrapping is attached without any overlap with the mineral fiber strip in the manner of a streamer around the outer circumference of the bale, whereby the length of the protective wrapping exceeds the nominal diameter of the bale merely by the circumferential width of the bonding zone of, for example, 20 cm. In a bale with an average diameter of 55 cm, there is thus instead of the length of the protective wrapping of much over 3 m, one of only about 1.9 m, thus a saving of material for the protective wrapping in a magnitude of 40%.

Thus, to be sure, from DE-OS No. 17 86 067 it is already known how to enclose thin, stiff materials—such as roofing materials, e.g., tar paper, which are wound into a firm roll—with a protective wrapping, so that the front end of the protective wrapping at a distance from the outer end of the last winding of the winding material is placed on the bale and that the length of the protective wrapping exceeds the circumference of the enclosed bale essentially only by the circumferential width of the bonding zone between the back end of the protective wrapping and the outside of the winding of the protective wrapping under it. In this process, the rolls or windings of the tar paper are produced in the usual manner and, completely wound, fed into a packaging machine which applies the protective wrapping. For this purpose, the front end of the protective wrapping is provided with an adhesive strip and introduced with proper timing between the rotating winding or bale of the tar paper and its lower support rolls, so that a bond between the front end of the protective wrapping and the outside surface of the tar paper essentially is being produced on the side of the winding or bale opposite the trailing end of the tar paper. Through the quickly effective, strain-resistant bond between the front end of the protective wrapping and the bale, because of the rotation of the bale, a further protective wrapping is pulled along under tension and tightly wrapped around the bale until the back end of the protective wrapping overlaps the front end and is also fastened there by means of an adhesive.

With such an enclosing of an incompressible, thin, relatively stiff material such as tar paper, different technological conditions are present than in the enclosing of a felt roll. The known stiff material can be kept in intermediate storage and can be handled while the enclosing of a felt roll is economically possible only as part of the winding process, since otherwise special additional measures would have to be taken to avoid unwinding of the wound bale made of compressed mineral fiber material because of internal tension. In the case according to the invention, the purpose of enclosing with the protective wrapping thus is not only for outside protection but also to maintain the roll shape of the bale. In doing so, there have always been difficulties in feeding the protective wrapping into the end phase of the winding of the rotating bale, so that under production engineering conditions the front end of the protective wrapping is assuredly carried, because gluing the protective wrapping on is out of the question on account of the proneness to damage of the backing of the felt roll. The known method of simply gluing on the front end of the protective wrapping just as the back end therefore cannot be resorted to in the case according to the invention. Without such bonding and without mechanical carrying by means of a holding device of the front end of the protective wrapping in the final winding of the mineral fiber strip it is, however, not evident how the required carrying force of the rapidly rotating felt roll bales can be transferred to the protective wrapping. Only the invention makes a surprising approach possible here because such carrying can be attained jointly with the friction of the protective wrapping on the outside surface of the bale, so that an adhesion effect of the front end of the protective wrapping on the closed-face outer surface of the backing can be induced without adhesive, which, on the one hand, transfers adequate carrying force to the protective wrapping but, on the other hand, excludes the possibility of damage to the backing during unpacking of the bale.

Further advantageous developments of the process according to the invention relate especially to advantageous possibilities of attaching the front end of the protective wrapping by adhesion to the bare closed-face outer circumference of the winding bale, so that no damage to the backing of the felt roll can occur when the user removes the protective wrapping.

Especially water with low surface tension or a liquid hydrocarbon which is suitable as sticking agent is useful between the protective wrapping and the continuous outer circumference of the felt roll; in the case of the water, it gradually evaporates and also oil or the like makes possible removal of the protective wrapping from the bale without exerting any force when the user unpacks it.

The invention is explained below in greater detail by means of a diagrammatically presented embodiment of a device according to the invention.

The single figure of the drawing provides a schematically simplified side view of a device according to the invention.

The drawing shows a feed conveyor 1 for mineral fiber strip 2 whose end area 3, developed as a separate conveyor belt, is shown in the drawing. In the operating position shown, in a winding station 4 placed at the end of the end area 3, a windind or bale 5 has already been formed from the felt roll 2, as is known in the art. In this connection, the front edge of the mineral fiber strip 2 as part of the transport on feed conveyor 1, comes into the area of a lifting conveyor 6 at the end of feed conveyor 1 and there is deflected upward in the drawing and bent back in an arc which is taken hold of by a card-roller arrangement that can be moved back and forth according to double arrow 7 and is bent back onto the backside of the strip of the mineral fiber strip 2. In this manner, the entire length of a cut segment of mineral fiber strip 2 is wound into a bale whose average diameter d, indicated by dash-dot, may have a size of, e.g., 55 cm. Depending upon the thickness of the mineral fiber strip 1, the trailing end **2*a*** of the latter protrudes over the average diameter d and forms the end-side step several centimeters high, depending upon the thickness of the mineral fiber strip just processed, for example in the form of a felt-backed roll.

When bale 5 is formed in the customary way explained above, it is enclosed completely around the entire circumference with a protective wrapping 9, which is available on a feed conveyor 10 placed above feed conveyor 1 and after forming a bale 5 is fed intermittently to the outer circumference of the rotating bale 5. The placing of the protective wrapping 9 occurs in the customary manner starting from segments of a dispenser bale of protective wrapping 9 and conveying it onto feed conveyor 10 in the direction of the winding station 4 until the front edge **9*a* of the protective wrapping 9, which in the operating position shown in the drawing is already close to the outer circumference of bale 5, comes to rest at a position designated as 11 at the front end segment of feed conveyor 10. For this purpose, feed conveyor 10 can be formed in the manner known in the art as a belt conveyor with a multiplicity of relatively narrow strips lying side-by-side, which run on suction boxes 10*a* which can produce low pressure in the interval between adjoining conveyor belts. If there is no low pressure, then the protective wrapping 9 lies on top of the narrow conveyor belts and is carried by them. As soon as the segment of the protective wrapping is to be stopped, the low pressure is activated and pulls the protective wrapping into the area between the running conveyor belts to the stationary surface of the suction boxes 10*a*, so that the protective wrapping 9 is safeguarded against being carried by the running conveyor belts. As is readily evident, such a customary low pressure control of the interruption of the feed movement of the segments of the protective wrapping 9 under severe operating conditions provides only an approximate definition of the position at rest of forward edge 9***a* of the protective wrapping 9 at the point 11 on feed conveyor 10 provided for it if an excessive control effort is to be avoided.

If the trailing end 2*a* of the mineral fiber strip 2, after first-time complete formation of bale 5, has passed for the first time the discharge area of feed conveyor 10 for the protective wrapping 9 and is at a distance from it, the segment of the protective wrapping 9 lying on feed conveyor 10 is released by interrupting the low pressure in the suction boxes 10*a*, so that the protective wrapping is again carried by friction on the conveyor belts and with its front edge 9*a* is placed on the over circumference of bale 5 formed from mineral fiber strip 2. Here, in a manner explained in detail below, a fastening effect between the closed-face bare outer surface of bale 5 and the adjoining area of the protective wrapping 9 in the area of its front edge 9*a* must be achieved so that the protective wrapping 9 is carried by the rotating bale 5. The drawing shows a middle position of this carrying movement in which the front edge 9*a* of the protective wrapping 9 after pressure by the lifting conveyor 6, which can also be formed by conveyor belts, has already been carried by more than about half a turn of bale 5 and runs in the direction of the card roller arrangement 8. At this point, the back end of the segment of the protective wrapping 9, designed as 9*b*, still lies on feed conveyor 10 of the protective wrapping and through the pull of the rotating bale 5 on the protective wrapping 9, is optionally supported by the slower running conveyor belts of feed conveyor 10, is carried and pulled into the winding station 4. Before that, the protective wrapping 9 in the area of the back edge 9*b* has been, for example, sprayed with adhesive substance. With bale 5 continuing to turn from the position shown in the drawing, at first the trailing end 2*a* of the mineral fiber strip 2 passses by the discharge area of feed conveyor 10 for the protective wrapping 9, while a considerable length of the protective wrapping 9 lies on the feed conveyor 10 and is carried from there under tension. If turning of bale 5 from the shown position is continued, the trailing end 2*a* of the mineral fiber strip covered by the protective wrapping 9, as a result of the weight of bale 5 as well as the forces applied by the lifting conveyor 6 and the card roller arrangement 8 is pressed against the feed conveyor 1 and forced nearly within the area shown in broken lines for the nominal diameter d as a result of the compressibility of the felt roll and protected from its outside by the protective wrapping 9. Then the back edge 9*b* of the protective wrapping 9 runs from feed conveyor 10 and is put on top of the outside of the area of the front edge 9*a* of the protective wrapping 9 and if turning continues is pressed onto and bonded through pressure of feed conveyor 1.

The bonding zone created on the outside of the area of the front edge 9*a* of the protective wrapping 9 between the outside of the area of the front edge 9*a* and the inside of the area of the back edge 9*b* of the protective wrapping 9 lies at a substantial distance from the protruding trailing end 2*a* of the mineral fiber strip 2 and is largely uninfluenced by it. Insofar as forces can be introduced into the bonding zone by resilience of the trailing end 2*a*, exclusively shearing forces are involved which can be well absorbed by the bonding; spreading forces which seek to split the protective wrapping segments that are lying upon one another and are bonded do not occur at all. Furthermore, it is of special advantage that the trailing end 2*a* of mineral fiber strip 2 be covered by the protective wrapping 9 lies on feed conveyor 10 and can be held back there by friction, which optionally can even be increased by setting a slight low pressure in the suction boxes 10*a*, so that the protective wrapping 9 tightly spans the trailing end 2*a* of the mineral fiber strip 2 with considerable tensile strength and thus holds it down after renewed removal of the trailing end 2*a* from the surface of feed conveyor 1. As a result, the outer circumference of the completed bale 5 enclosed in the protective wrapping 9 is better adapted to the ideal nominal circumference in the area of the protruding trailing end 2*a*, which improves not only the visual appearance but also facilitates further handling of the finished product by improved winding capability, and undisturbed stackability, for example.

In this process, as is readily evident, only such a length of the protective wrapping 9 is required which results in adequate overlapping in the area of the front edge 9*a* and the back edge 9*b* lying thereon, so that the length of the protective wrapping 9 at the outer cirumference of bale 5 must correspond merely to the length of the bale circumference plus the overlap of, e.g., 20 cm required for bonding. In this process, furthermore, special requirements for the precision of the feed control of the protective wrapping 9 are unnecessary or, in the case of imprecise control of the feed of the protective wrapping 9, no compensation whatsoever by extra length of the protective wrapping 9 is required; for it completely suffices if the front edge 9*a* of the protective wrapping 9 ends up at a distance of, e.g., a few decimeters in front of or behind the trailing ends 2*a* of the mineral fiber strip 2; exact adherence to a specific position does not matter. In the example shown, the front edge 9*a* of the protective wrapping 9 has been placed on bale 5 relatively early and thus is at a comparatively short distance behind the trailing end 2*a* of the mineral fiber strip 2. Also, however, the front edge 9*a* of the protective wrapping could be in the displayed pivoting position of bale 5 somewhere in the area between the application surfaces of feed conveyor 1 and the lifting conveyor 6 on bale 5 without this causing any disturbances or also without even resulting in any marked changed in the wrapping conditions. By allowing for a specific length of the applied segment of the protective wrapping 9, automatically following a full revolution, the back edge 9*b* of the protective wrapping 9 rests on the outer surface of the front edge 9*a*, whereby change in the position of the front edge merely leads to a corresponding change of the bonding spot at the circumference of the bale without a disturbing change of the operating conditions.

It is customary for the backed felt in the end area 3 of feed conveyor 1 to work with conveyor belts lying at a distance from one another that run over a suction box 1*a* provided with suction openings. Through the suction of the air pulled into suction box 1*a* through the suction openings, the strip of the mineral fiber strip is pressed more firmly onto the conveyor belts and thus their conveyor effect is increased by friction, so that the strip of the mineral fiber strip 2 is pushed into the winding station 4 with appropriate firmness and there can be transformed for winding or for bale 5.

To support the adhesive effect of the front edge 9*a* of the protective wrapping 9 at the outer circumference of bale 5, it is provided according to the invention in the area of the contact surface of bale 5 on feed conveyor 1, in place of a suction air box 1*a*, a compressed air box 1*b* and also to provide in the area of the lifting conveyor 6 a compressed air box 6*b* with blowing orifices—not shown in detail—between the conveyor belts. The compressed air boxes 1*b* and 6*b* can be operated with a feed pressure of about 400 to 600 mm water column and with suitable arrangement and sizing of the blowing orifices produce an additional pressing of the front edge 9*a* of the protective wrapping 9 onto the circumference of bale 5 by air flow also at a distance from the application areas of bale 5 on feed conveyor 1 or lifting conveyor 6. It has been determined that up to conveying speeds of the mineral fiber strip 2 on feed conveyor 1 of about 80 m/min that one could do without such support from compressed air boxes 1*b l and* 6*b* without any problem; however, at higher feeding speeds, which can go as high as 140 m/min or even higher, said compressed air support is of considerable value.

The adhesive effect of front edge 9*a* of the protective wrapping 9 on the bare continuous outer circumference of bale 5 can be achieved in various ways. Especially in using a plastic film as protective wrapping 9, the protective wrapping 9 can be electrostatically charged in a way not shown and known in the art and can adhere because of this charge. In this process, the adhesive effect through the charge need not be restricted by any means to front edge 9*a* of the protective wrapping 9 but can increase the friction carrying of the protective wrapping 9 at the outer circumference of the rotating bale 5 of the entire surface of the protective wrapping. A prerequisite for such an electrostatic charge either of the protective wrapping 9 or of the outer circumference surface of bale 5 is, however, an appropriate selection of material, as the adhesion by electrostatic charge cannot be achieved in every case.

Therefore it is possible to provide, optionally also additionally, especially in the area of the front edge 9*a* of the protective wrapping 9, or the base surface of the backing strip for applying a sticking agent to it. However, such a sticking agent, in contrast to the adhesive substance which at the same time can be applied to the back edge 9*b* of the protective wrapping 9, should not produce a lasting bonding connection or the like but only a sticking during the wrapping which should be either eliminated no later than the time of removal of the protective wrapping 9 by the user of the felt roll 2 or so made that its removal is easily possible without damaging the outer surface of bale 5.

Thus, for example, a material should be considered as a sticking agent whose adhesive effect can be eliminated by a so-called "peel-off" effect, as is customary with the so-called adhesive sealings.

Application of sticking agents customary for adhesive sealings on the one hand is, however, relatively expensive and, on the other hand, does not completely eliminate damages caused by the user through improper removal of the protective wrapping 9. Therefore, it is preferable to use as the sticking agent a liquid which results in an essentially continuous liquid film in the area of the front edge 9*a* of the protective wrapping 9, which achieves the desired adhesive effect by physical forces of adhesion, as well as inner forces of cohesion. In this connection, fundamentally a whole series of wetting liquids should be considered which include especially liquid hydrocarbons. Especially appropriate is the selection of a liquid that evaporates essentially without residue—especially without additional measures—e.g., liquids with a base of volatile alcohols, ethers, or the like.

In the case of the example, water with low surface tension is used as a sticking agent. Water with low surface tension is a good wetting liquid which forms a continuous liquid film and therefore results in a good adhesive effect. Following the wrapping, the water, which has been introduced in a very small quantity, simply dries up and evaporates in this manner, so that when the protective wrapping 9 is removed by the user, its front edge 9*a* simply rests on the outer circumference of bale 5 without any adhesive effect or other connection and falls off after removing the adhesive link. Moreover, water with low surface tension is inexpensive and can be handled and worked without any problems.

To apply the liquid as a sticking agent, in the case of the example water with low surface tension, a sponge 13 serves as a coating device 12 which is fastened to a pivoting ramp 14 and is soaked with the liquid serving as a sticking agent in a manner not described in detail. The pivoting ramp 14 is arranged in the feed direction of the protective wrapping 9 shortly before stop 11 for the front edge 9*a* of the protective wrapping 9 and, according to double arrow 15, can be lowered to the surface of feed conveyor 10 and again lifted from this surface and can be moved, in a manner not shown in detail, vertically to the drawing surface along the front edge 9*a* of the protective wrapping 9. If necessary, a component in the drawing surface can be superposed in this movement vertically to the drawing surface, e.g., in the direction on the edge of the front edge 9*a* of the protective wrapping 9 to wet it completely and to avoid removal of the front edge 9*a* of the protective wrapping 9 under all circumstances. At any rate, sponge 13 thus performs a wiping motion on the topside of the protective wrapping 9 in the area of its front edge 9*a*, which guarantees clean application of a continuous liquid film.

With an area of the front edge 9*a* so wetted, the protective wrapping 9, because of the elimination of the low pressure in the suction boxes 10*a*, feeds toward the bare circumference surface of bale 5 at as great a distance as possible from the trailing end 2*a* of the mineral fiber strip 2, adheres there and is carried via the shown intermediate position to the point where the back edge 9*b* of the protective wrapping 9 overlaps the carried front edge 9*a* and is bonded there. In this manner, it is possible to produce bales 5 with a good round circumferential surface continuously enclosed over the entire circumference with small consumption of material for the protective wrapping 9 in rapid order, so that, depending on the feed speed of the mineral fiber strip 2 on the feed conveyor, production of enclosed bales with cycle times of less than 10 seconds with best possible production certainty is feasible.

Having now fully described this invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for wrapping a rotating bale of backed mineral fiber strip in the form of a felt-roll with an outer closed-face backing strip with protective wrapping applied as part of the winding process for packaging which comprises:

(a) bringing the protective wrapping, having a coating of adhesive material at the back end thereof, into the circumferential area of the rotating bale with the front end thereof, with a length exceeding the circumference of the bale and being frictionally connected to the bale; wherein the frictional sticking connection between the front end of the protective wrapping and the bale is produced exclusively by an adhesion effect caused by the presence of a volatile liquid forming a substantially continuous film deposited between the inner surface facing the bale and the bare outer surface of the backing strip, allowing the volatile liquid to evaporate to eliminate the initial adhesion effect; and (b) turning the bale and pressing the back end of the protective wrapping onto the outside of the winding of the protective wrapping, therebelow, to attain a lasting bonding, wherein the front end of the protective wrapping is placed on the bale at a distance from the outside end of the last winding of the felt roll, and wherein the length of the protective wrapping exceeds the circumference of the enclosed bale substantially only by the circumferential width of the bonding zone between the back end of the protective wrapping and the outside of the winding of the protective wrapping lying thereunder.

2. The process as in claim 1, wherein the front end of said protective wrapping is placed on the bale at a distance behind the outside end of the last winding of the felt roll.

3. The process of claim 1, wherein said film forming liquid is applied to the bare outer surface of the backing strip to attain said adhesive effect.

4. The process as in claim 3, wherein a volatile liquid substantially free from residue is used as the film forming liquid.

5. The process as in claim 4, wherein said volatile liquid substantially free from residue is selected from the group consisting of volatile alcohols and ethers.

6. The process as in claim 3, wherein water having a low surface tension is used as the film forming liquid.

7. The process as in claim 3, wherein said film forming liquid is a liquid hydrocarbon.

8. The process as in claim 1, wherein said film forming liquid is applied only to the inner surface of the front end of the protective wrapping to attain said adhesive effect between the inner surface of the front end of the protective wrapping and the bare outer surface of the backing strip.

9. The process of claim 1, wherein said backing strip is comprised of a layer of aluminum.

* * * * *